US008066342B2

(12) United States Patent
Hwang

(10) Patent No.: US 8,066,342 B2
(45) Date of Patent: Nov. 29, 2011

(54) REFRIGERATOR WITH HOME BAR

(75) Inventor: Sun-Myung Hwang, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 135 days.

(21) Appl. No.: 12/444,825

(22) PCT Filed: Oct. 23, 2007

(86) PCT No.: PCT/KR2007/005196

§ 371 (c)(1),
(2), (4) Date: Apr. 8, 2009

(87) PCT Pub. No.: WO2008/050986

PCT Pub. Date: May 2, 2008

(65) Prior Publication Data

US 2010/0072870 A1 Mar. 25, 2010

(30) Foreign Application Priority Data

Oct. 24, 2006 (KR) ..... 10-2006-0103535

(51) Int. Cl.
*A47B 96/04* (2006.01)

(52) U.S. Cl. ..... 312/405.1; 312/321.5

(58) Field of Classification Search ..... 312/405.1, 312/405, 321.5, 292, 271, 273, 274, 319.5–319.8, 312/326, 329, 334.27, 331, 307, 310, 311; 74/89.17, 412 R, 422; 49/333, 334, 335, 49/336; 62/303, 250, 336

See application file for complete search history.

(56) References Cited

U.S. PATENT DOCUMENTS

| | | | | | |
|---|---|---|---|---|---|
| 2,361,525 | A | * | 10/1944 | Ball et al. | 312/274 |
| 2,473,467 | A | * | 6/1949 | Burt | 126/340 |
| 2,752,910 | A | * | 7/1956 | Lysles | 126/19 R |
| 2,814,545 | A | * | 11/1957 | Cornish | 312/271 |
| 2,836,477 | A | * | 5/1958 | Karoff | 312/271 |
| 2,975,012 | A | * | 3/1961 | Thull | 312/274 |
| 3,184,276 | A | * | 5/1965 | Billups | 312/274 |
| 3,383,148 | A | * | 5/1968 | Dicken, Jr. | 312/311 |
| 4,087,140 | A | * | 5/1978 | Linstromberg | 312/292 |

(Continued)

FOREIGN PATENT DOCUMENTS

JP 02103388 * 4/1990

(Continued)

OTHER PUBLICATIONS

Translation of Korean Patent Document (KR-10-2004-0046105-A) Tae-Hwan Jeong, Oct. 2004.*

(Continued)

*Primary Examiner* — Darnell Jayne
*Assistant Examiner* — Hiwot Tefera
(74) *Attorney, Agent, or Firm* — Birch, Stewart, Kolasch & Birch, LLP

(57) ABSTRACT

A refrigerator with a home bar includes a main body of the refrigerator having a cooling chamber, a refrigerator door configured to open or close the cooling chamber and having an opening, and a home bar. The home bar includes a housing coupled to the opening and having a storage space therein, a home bar door for opening or closing the opening, and a home bar door driving unit for driving the home bar door to open or close the opening. Consequently, a gap increasing between the home bar door and the opening can be avoided so as to prevent leakage of cold air.

17 Claims, 12 Drawing Sheets

U.S. PATENT DOCUMENTS

| | | | | |
|---|---|---|---|---|
| 6,499,818 | B2 * | 12/2002 | Brustle | 312/319.1 |
| 6,702,411 | B2 * | 3/2004 | Helver | 312/333 |
| 7,430,937 | B2 * | 10/2008 | Rotter et al. | 74/422 |
| 7,500,400 | B1 * | 3/2009 | Huber | 73/795 |
| 2003/0080131 | A1 * | 5/2003 | Fukuo | 220/264 |
| 2003/0122459 | A1 * | 7/2003 | Huber et al. | 312/319.6 |
| 2004/0148958 | A1 * | 8/2004 | Park | 62/381 |
| 2006/0103273 | A1 * | 5/2006 | Lee et al. | 312/236 |
| 2006/0138920 | A1 * | 6/2006 | Jang | 312/405 |
| 2007/0290587 | A1 * | 12/2007 | Jeansonne et al. | 312/311 |
| 2008/0252191 | A1 * | 10/2008 | Kim et al. | 312/405.1 |
| 2008/0297019 | A1 * | 12/2008 | Kim | 312/405 |
| 2009/0009043 | A1 * | 1/2009 | Gwak | 312/405.1 |
| 2009/0243454 | A1 * | 10/2009 | Yoo et al. | 312/405.1 |
| 2009/0261701 | A1 * | 10/2009 | Yun et al. | 312/405 |
| 2010/0084956 | A1 * | 4/2010 | Kim et al. | 312/405.1 |
| 2010/0253191 | A1 * | 10/2010 | Backhaus et al. | 312/309 |
| 2010/0281911 | A1 * | 11/2010 | Ha | 62/449 |

FOREIGN PATENT DOCUMENTS

| | | | |
|---|---|---|---|
| KR | 20030053875 | * | 7/2002 |
| KR | 10-2004-0046105 | A | 5/2004 |
| KR | 10-2005-0095361 | A | 9/2005 |
| KR | 10-2006-0054935 | A | 5/2006 |

OTHER PUBLICATIONS

Translation of Korean Patent Document (KR 10-2004-0046105) Tae-Hwan Jeong, Oct. 2004.*

* cited by examiner

[Fig. 5]
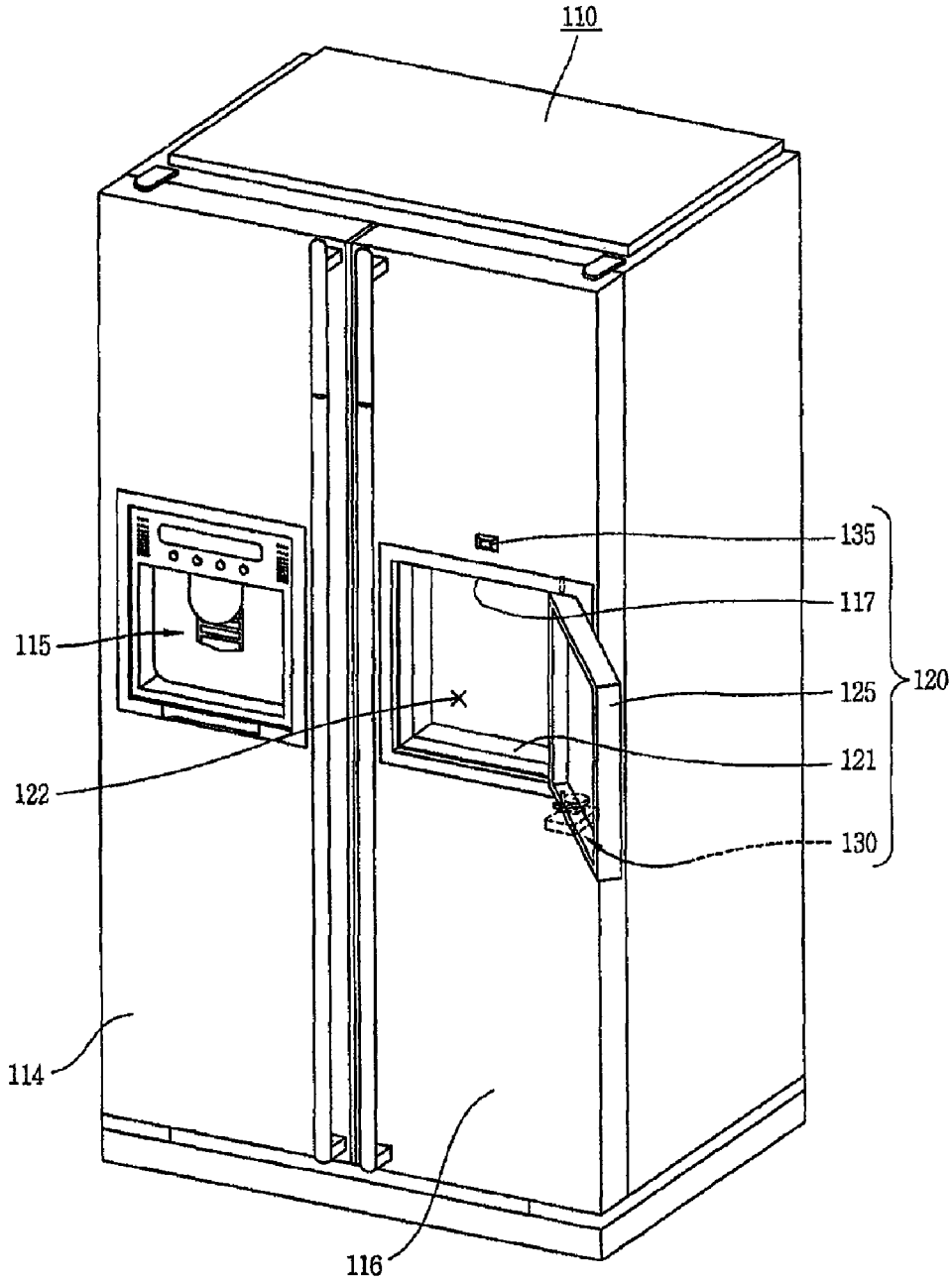

[Fig. 6]
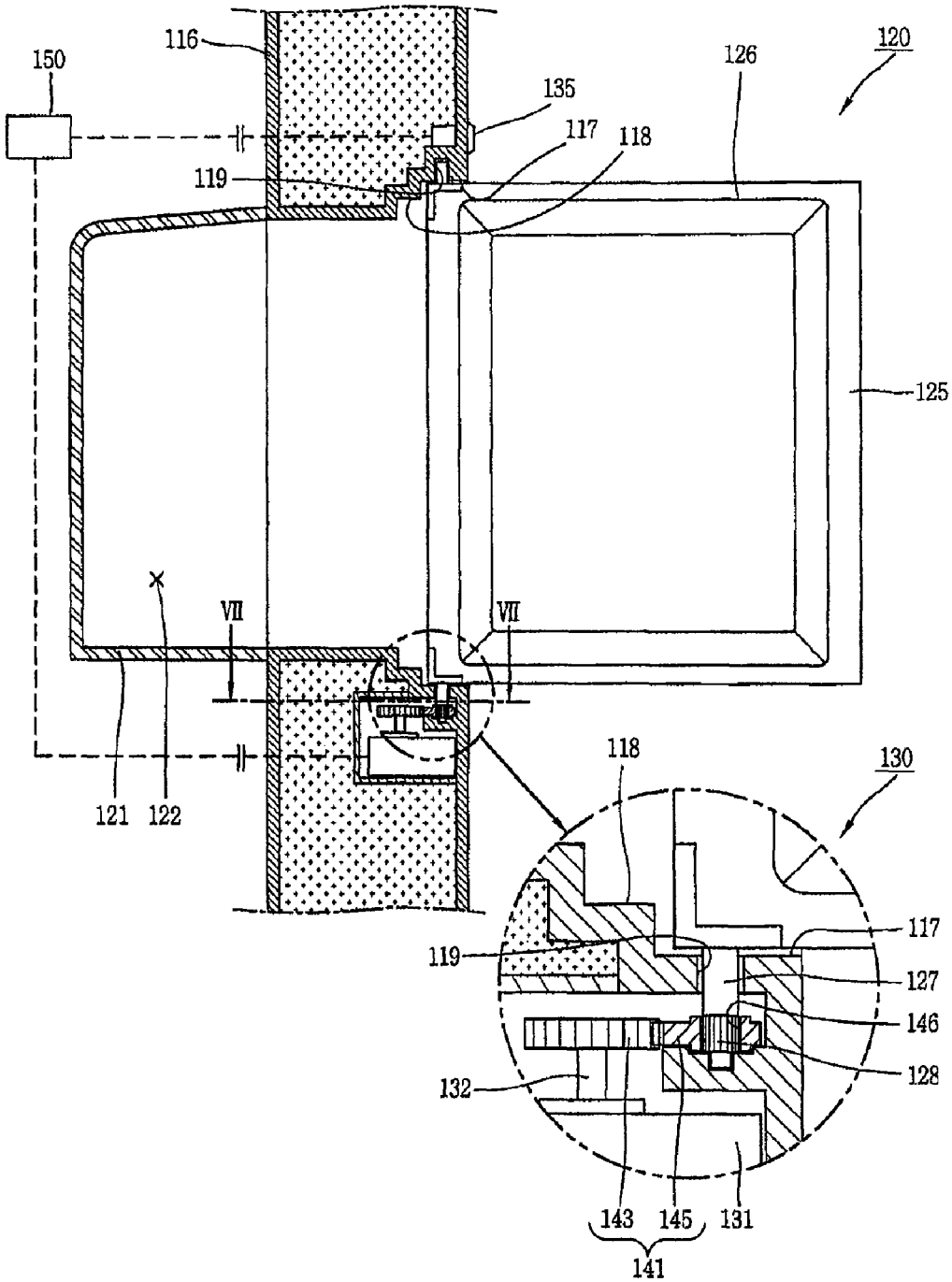

[Fig. 7]
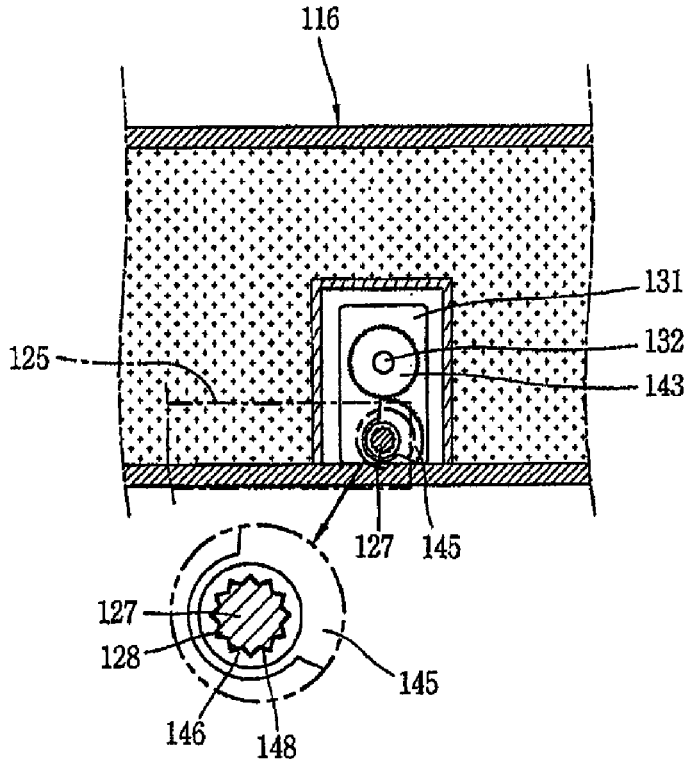
[Fig. 8]
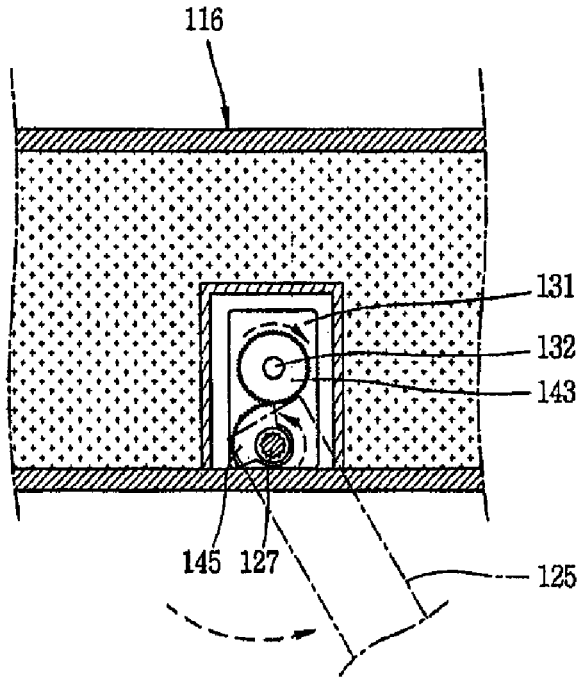

[Fig. 9]
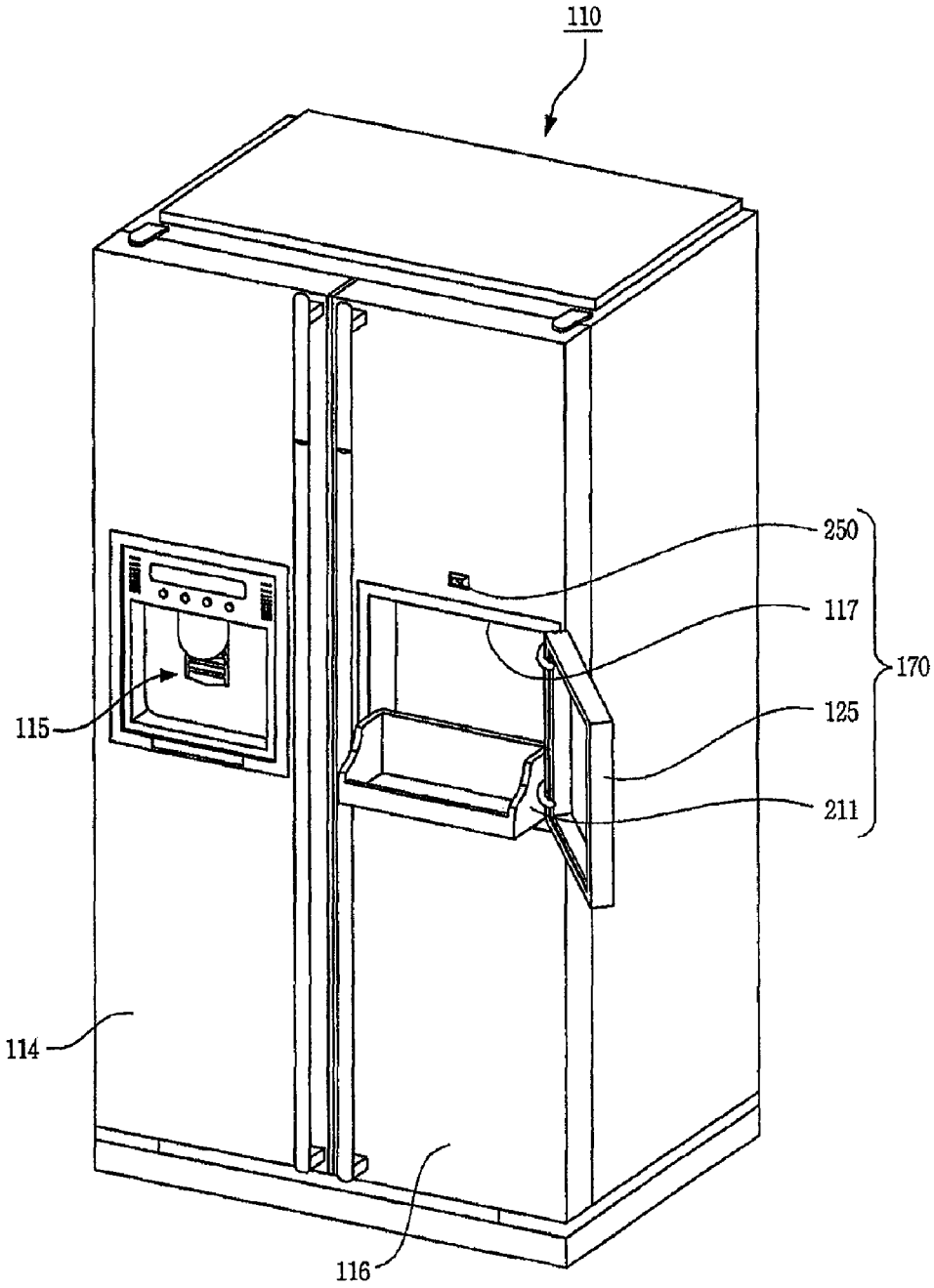

[Fig. 10]
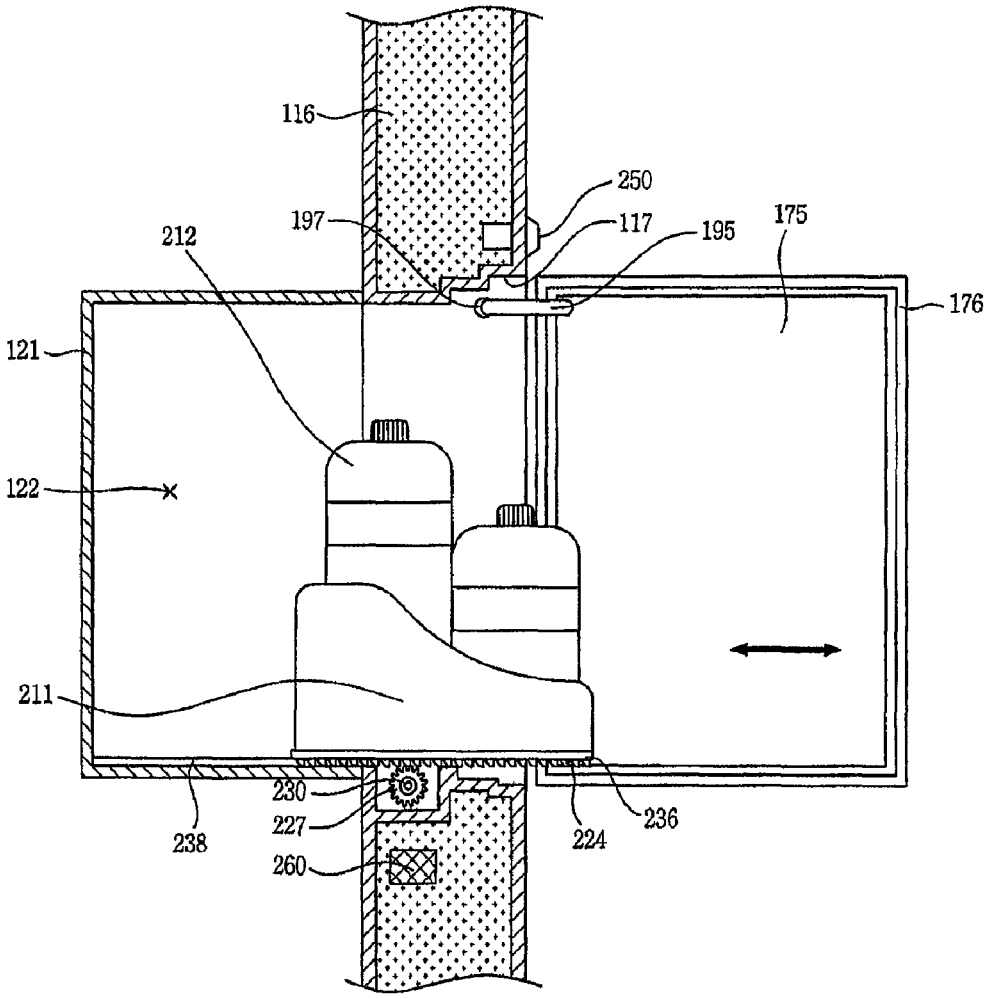

[Fig. 11]
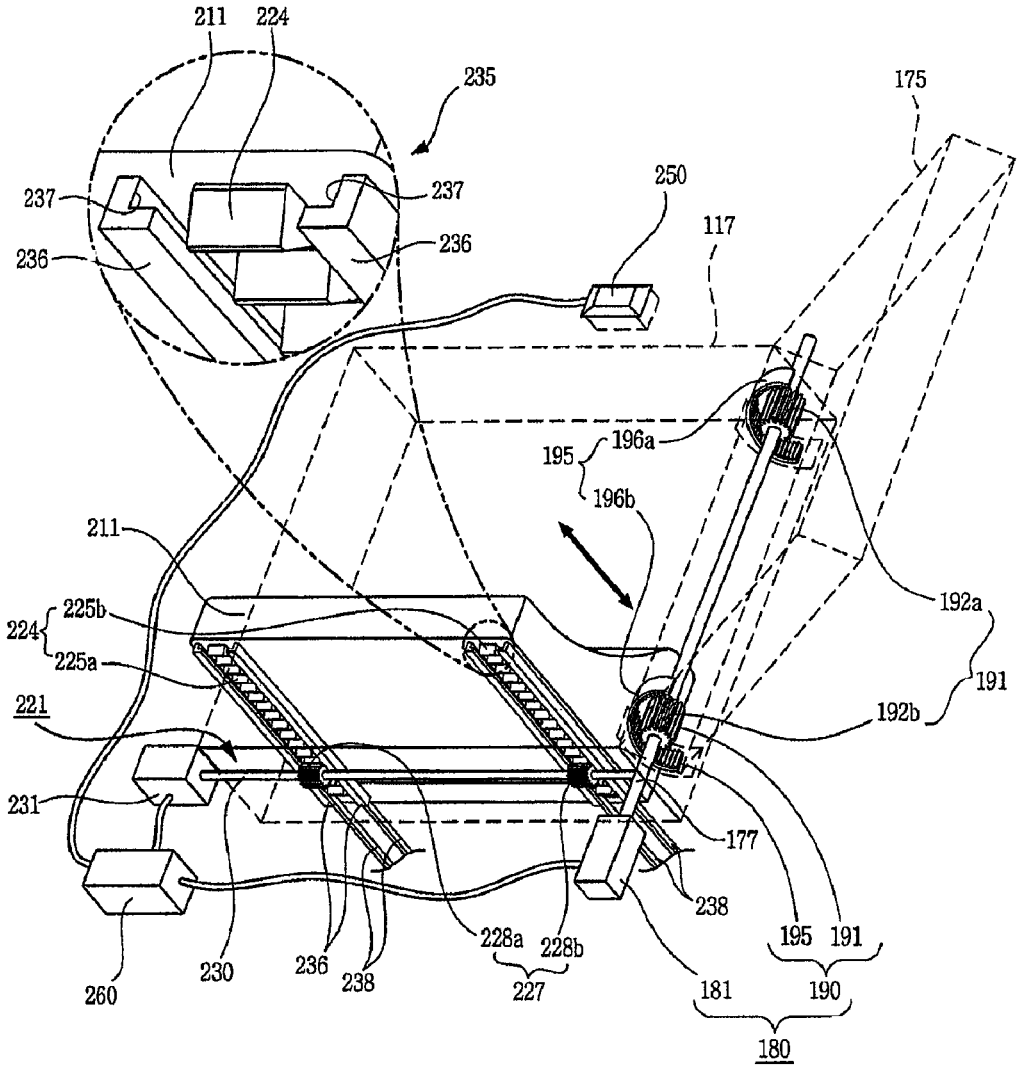

[Fig. 12]
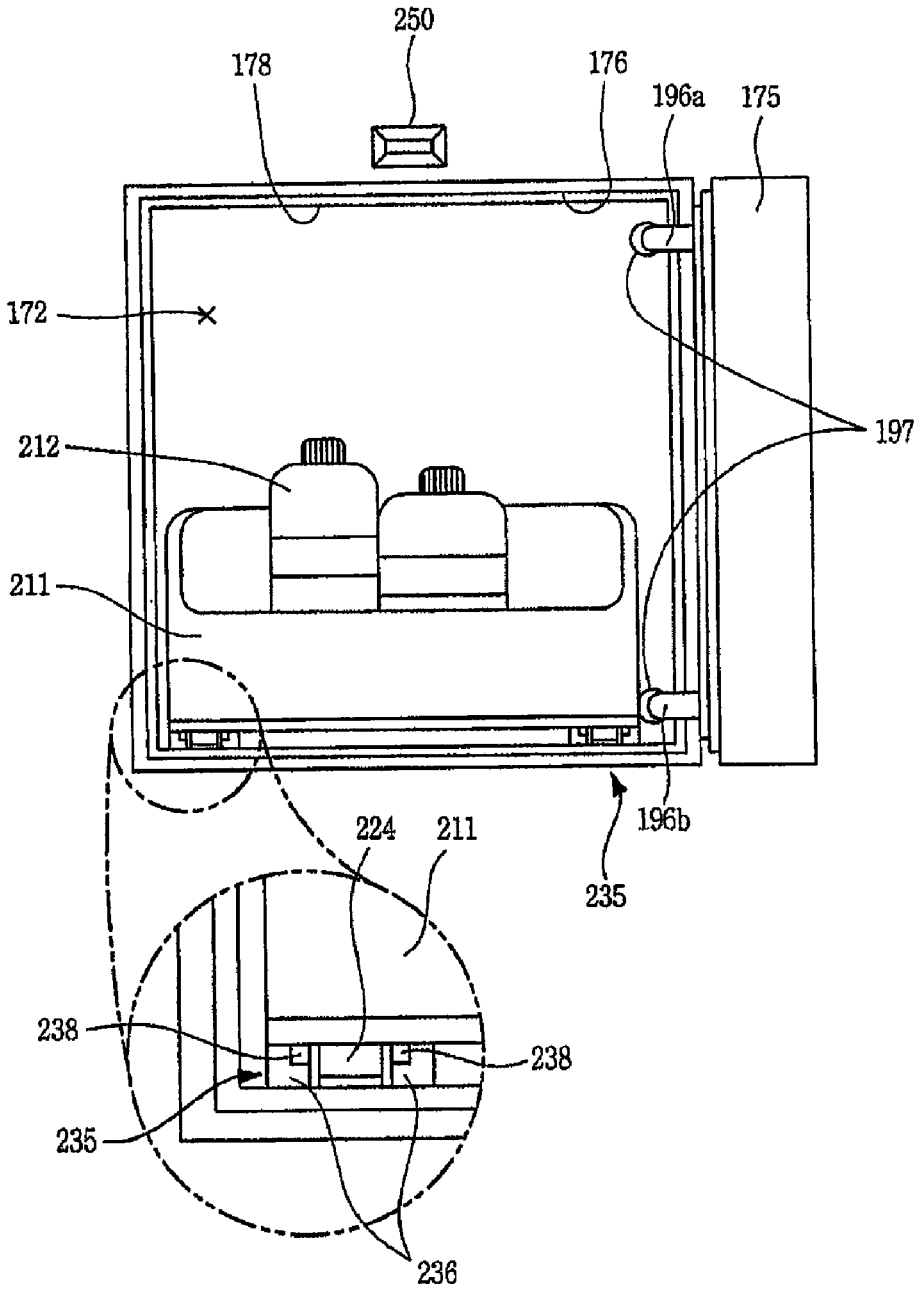

[Fig. 13]
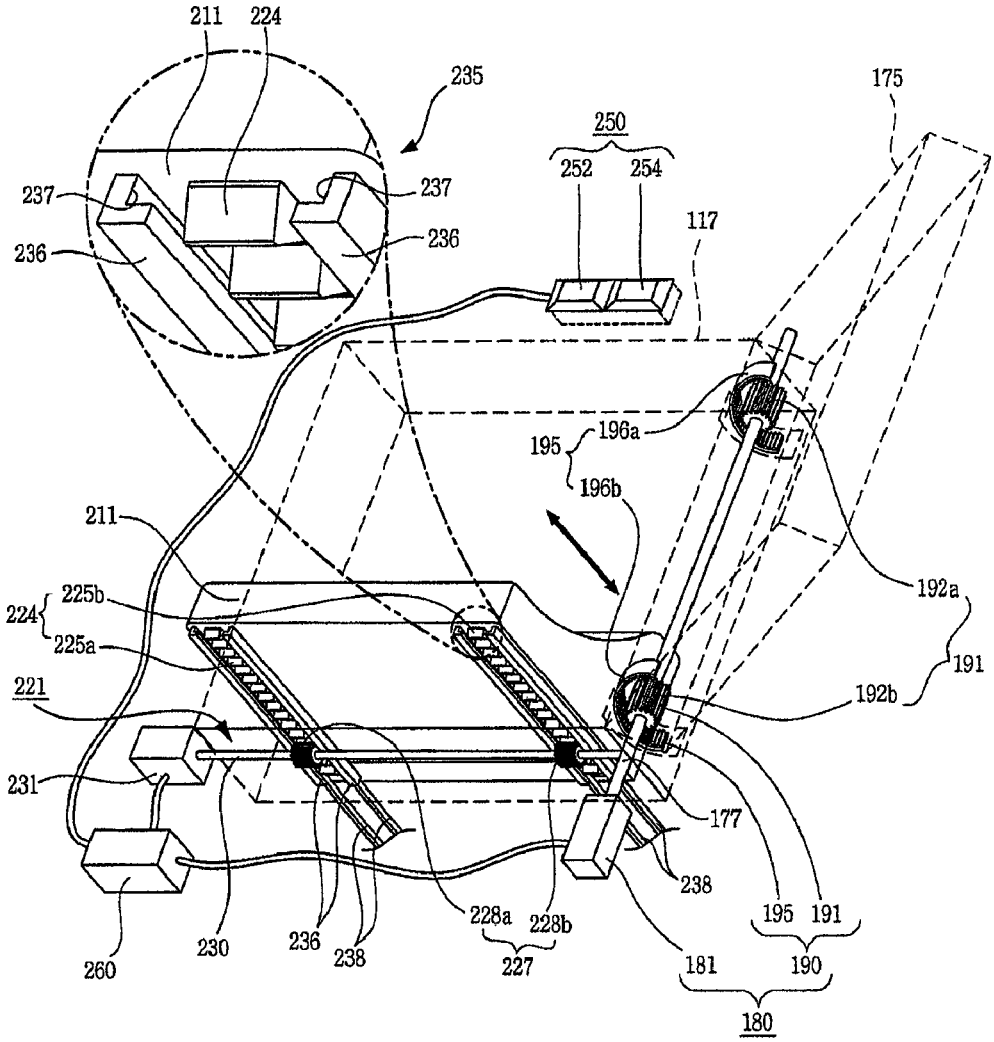

REFRIGERATOR WITH HOME BAR

TECHNICAL FIELD

The present invention relates to a refrigerator with a refreshment center (e.g., so-called "home bar"), and more particularly, to a refrigerator with a home bar capable of avoiding a gap between a home bar door and an opening.

BACKGROUND ART

FIG. 1 is a perspective view showing a refrigerator with a home bar according to the related art, FIG. 2 is a horizontal cross-sectional view of a home bar area of FIG. 1, FIG. 3 is a perspective view of an opening/closing unit of FIG. 2, and FIG. 4 is a view showing an unlocked state of a rotational latch of FIG. 3. As shown in FIGS. 1 to 4, the refrigerator with the home bar according to the related art may include a main body 11 of the refrigerator having a cooling chamber therein, a refrigerator door coupled to the main body 11 of the refrigerator to open or close the cooling chamber, i.e., a freezing chamber door 13 and a refrigerating chamber door 15 which open or close the freezing chamber and the refrigerating chamber, respectively, and a so-called home bar which is a refreshment center installed on the refrigerating chamber door 15.

A dispenser 18 which allows a user to take out ice and/or water with the refrigerating chamber door 13 closed may be defined on a front surface of the freezing chamber door 13.

The refrigerating chamber door 15 may include the home bar 20 from which a user can take out drinks or the like without opening the refrigerating chamber door 15. The home bar 20, as shown in FIG. 2, may include a housing 21 mounted at a rear surface of the refrigerating chamber door 15 to form a certain storage space 22, and a home bar door 25 for selectively opening/closing an opening 17 of the storage space 22. Drinks or the like may be stored in the storage space 22.

The opening 17 is formed to be stepped inwardly such that it can gradually be narrower in width. The home bar door 25 has a stepped portion 26 protruded to correspond to the shape of the opening 17 to prevent leakage of cold air when the home bar door 25 is closed.

Rotational shafts 27 may be formed at both lower sides of the home bar door 25. Each rotational shaft 27 may include a torsion spring 28 which applies an elastic force toward a direction in which the home bar door 25 is open.

A locking device 31 may be installed at an upper end of the home bar door 25 to allow the home bar door 25 to be selectively open or closed. The locking device 31 may include a rotational latch 33 coupled to the home bar door 25 to rotate based on a central axis, and a locking portion 35 fixed to the opening 17 of the refrigerating chamber door 15 and engaged with the rotational latch 33 to prevent the home bar door 25 from being unexpectedly opened. The rotational latch 33 may be provided with a torsion spring (not shown) disposed therein such that it can return to the original position thereof by an elastic force of the torsion spring after the rotation.

A handle 29 may be formed at the home bar door 25 to be movable. The handle 29 may be connected to one end of a handle connector 37, the other end of the handle connector 37 being connected to the rotational latch 33. When the handle 29 is drawn, the rotational latch 33 rotates in a direction in which the handle 29 is pulled. Accordingly, the rotational latch 33 is unlocked from the locking portion 35, by which the home bar door 25 may rotate downwardly.

When the home bar door 25 is open, the rotational latch 33 may return to the original position thereof by the torsion spring disposed inside thereof. When the home bar door 25 is closed again, an end of the rotational latch 33 comes in contact with an end of the locking portion 35. Here, upon applying a force more to the home bar door 25, the rotational latch 33 rotates in a direction opposite to the direction in which the home bar door 25 is open. When the rotational latch 33 rotates to be moved into the hollow space of the locking portion 35, the rotational latch 33 may return to its original position by the elastic force of the torsion spring. Accordingly, the locking portion 35 may come in contact with the rotational latch 33 so as to avoid the home bar door 25 from rotating downwardly.

However, the related art refrigerator with the home bar may have the following problems.

A user must inconveniently draw out the handle 29 to open the home bar door 25 and push the home bar door 25 to close it.

The storage space 22 is formed inside the refrigerating chamber door 15. Accordingly, in order to take items out of the storage space 22 or put items in the storage space 22, the user must put his hand into the storage space 22 with the refrigerating chamber door 15 open, which results in the user's inconvenience.

As the locking portion 31 of the home bar door 25 continues to be used, the elastic force of the torsion spring of the rotational latch 33 decreases, and thereby the rotational latch 33 is not maintained in the completely locked state to the locking portion 35. As a result, the home bar door 25 and the opening 17 come apart from each other to cause a gap to increase between the home bar door 25 and the opening 17, thereby causing leakage of cold air.

DISCLOSURE OF THE INVENTION

Therefore, it is an object of the present invention to provide a refrigerator with a home bar capable of avoiding a gap between a home bar door and an opening from increasing.

Another object of the present invention is to provide a refrigerator with a home bar capable of facilitating an opening/closing operation for a home bar door, and a withdrawal and reception for a basket for the home bar.

Still another object of the present invention is to provide a refrigerator with a home bar capable of separately controlling the opening/closing operation for the home bar door, and the withdrawal and reception for the basket for the home bar.

To achieve these objects, there is provided a refrigerator comprising: a main body of the refrigerator having a cooling chamber therein; and a home bar which includes a refrigerator door for opening or closing the cooling chamber and having an opening, a housing coupled to the opening and defining a storage space therein, a home bar door for opening or closing the opening, and a home bar door driving unit for driving the home bar door so as to open or close the opening.

Here, the home bar door driving unit may comprise a home bar door driving motor coupled to the refrigerator door, and a home bar door switch installed to be expose to the exterior.

The home bar door driving unit may further comprise a driving gear coupled to a rotational shaft of the home bar door driving motor, and a power transmitting gear coupled to a rotational shaft of the home bar door and engaged with the driving gear.

The rotational shaft of the home bar door may be configured to be disposed in a longitudinal direction.

The power transmitting gear may be implemented as a sector gear.

The power transmitting gear may have an arc (arch, arcuate, etc.) shape and have a teeth portion formed inside thereof to allow the power transmitting gear to be engaged with the driving gear.

The home bar may further comprise a basket received in the housing.

The home bar may further comprise a basket driving unit for driving the basket such that the basket can be drawn out through the opening.

The basket driving unit may comprise a basket driving motor for supplying a driving force to the basket, and a basket driving switch installed to be exposed to the exterior.

The basket driving unit may further comprise rack teeth portions formed on a lower surface of the basket, and pinions engaged with the rack teeth portions and coupled to a rotational shaft of the basket driving motor.

The home bar may further comprise a basket supporting unit for supporting the basket to be drawn out in back and forth directions.

The basket supporting unit may comprise guide rails formed on the lower surface of the basket, and guide bars fixed to the inside of the housing to support the guide rails.

In another aspect of the present invention, a refrigerator may comprise: a main body of the refrigerator having a cooling chamber; a refrigerator door for opening or closing the cooling chamber and having an opening; and a home bar which may include a housing coupled to the opening and forming a storage space therein, a home bar door having an upper and a lower portion for opening or closing the opening, a home bar door driving unit for driving the home bar door to open the opening, a basket received inside the housing, and a basket driving unit for driving the basket to be drawn out and received through the opening.

Here, the home bar may further comprise a manipulating unit installed to be exposed to the exterior of the refrigerator door, and a controller for controlling the home bar door driving unit and the basket driving unit based on a manipulating signal of the manipulating portion.

The home bar door driving unit may comprise a home bar door driving motor installed in the refrigerator door, and a plurality of gears interposed between the home bar door driving motor and a rotational shaft of the home bar door.

The basket driving unit may comprise rack teeth portions formed on the lower surface of the basket, pinions engaged with the rack teeth portions, and a basket driving motor for driving the pinions.

The rotational shaft of the home bar door may be disposed at one side of the home bar door in a longitudinal direction of the home bar door as shown in FIGS. 11 and 13, the rotational shaft extending from the upper portion of the home bar door to the lower portion of the home bar door having an upper region and a lower region each rotatably supported by the refrigerator door, and the gears may comprise a power transmitting gear having an arc (arch, arcuate, etc.) shape and having a teeth portion inside thereof, and a pinion coupled to the power transmitting gear by the teeth portion.

One end of the power transmitting gear is connected to the home bar door, and the power transmitting gear is disposed at each of upper and lower portions of the home bar door, respectively.

The rotational shaft of the home bar door may be formed to be vertically long, and the power transmitting gear is configured to be coupled simultaneously to the rotational shaft.

The home bar may further comprise a power transmitting gear receiving portion in which the power transmitting gear is received to be drawn out.

The home bar may further comprise a basket supporting unit for supporting the basket to be slidable in back and forth directions.

The basket supporting unit may comprise guide rails mounted on the lower surface of the basket, and guide bars disposed inside the housing to guide the guide rails.

EFFECT OF THE INVENTION

As described above, in the present invention, the home bar driving unit which drives the home bar door to open or close the opening is provided to prevent gap when the home bar door shields the opening, thereby improving reliability of the refrigerator.

Also, the present invention can be provided with the home bar door driving unit for allowing the home bar door to open or close the opening, the basket drawn out of or received in the inside of the home bar, and the basket driving unit for driving the basket to be drawn out or received through the opening, so as to facilitate the opening/closing of the home bar door and the withdrawal and reception of the basket, and avoid the gap increasing between the home bar door and the opening.

In addition, the prevent invention can be provided with a home bar door manipulating switch and a basket manipulating switch which manipulate the home bar door driving unit and the basket driving unit, respectively, so as to separately control the opening/closing operation for the home bar door and the withdrawal and reception operation for the basket, thereby enhancing user's convenience.

BRIEF DESCRIPTION OF THE DRAWINGS

FIG. 5 is a perspective view showing a refrigerator with a home bar in accordance with one embodiment of the present invention;

FIG. 6 is a longitudinal cross-sectional view of a home bar area of FIG. 5;

FIG. 7 is a cross-sectional view taken along the line VII-VII of FIG. 6;

FIG. 8 is a view showing a state of a power transmitting gear when a home bar door of FIG. 6 is closed;

FIG. 9 is a perspective view showing a refrigerator with a home bar in accordance with another embodiment of the present invention;

FIG. 10 is a longitudinal cross-sectional view of a home bar area of FIG. 9;

FIG. 11 is a perspective view showing a configuration of a home bar door driving unit and a basket driving unit of FIG. 10;

FIG. 12 is a front view of FIG. 10; and

FIG. 13 is a perspective view showing a configuration of a home bar in accordance with another embodiment of the present invention.

MODES FOR CARRYING OUT THE PREFERRED EMBODIMENTS

Figure 1:
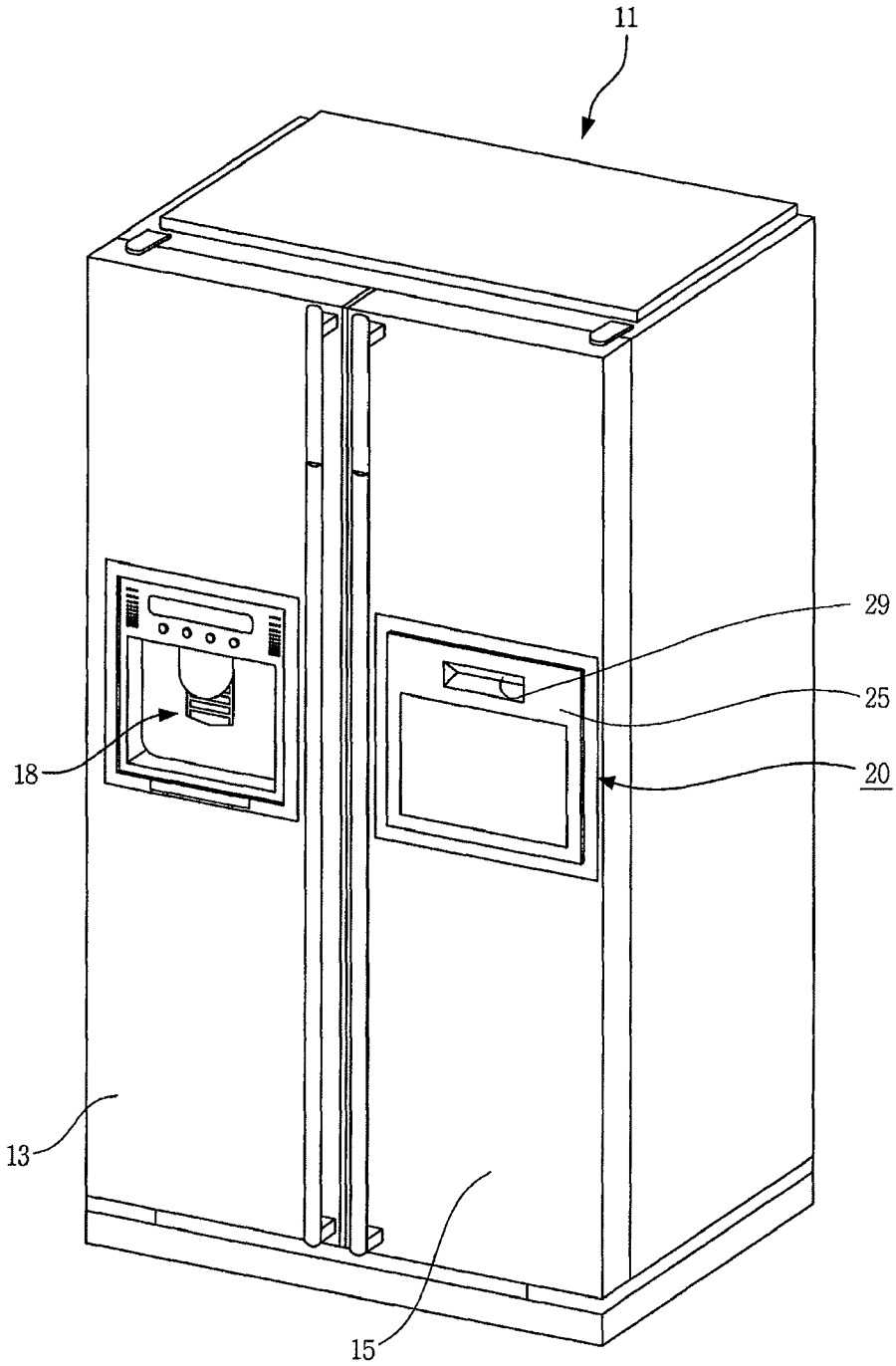
FIG. 1 RELATED ART
FIG. 1 is a perspective view showing a refrigerator with a home bar according to the related art.
Figure 2:
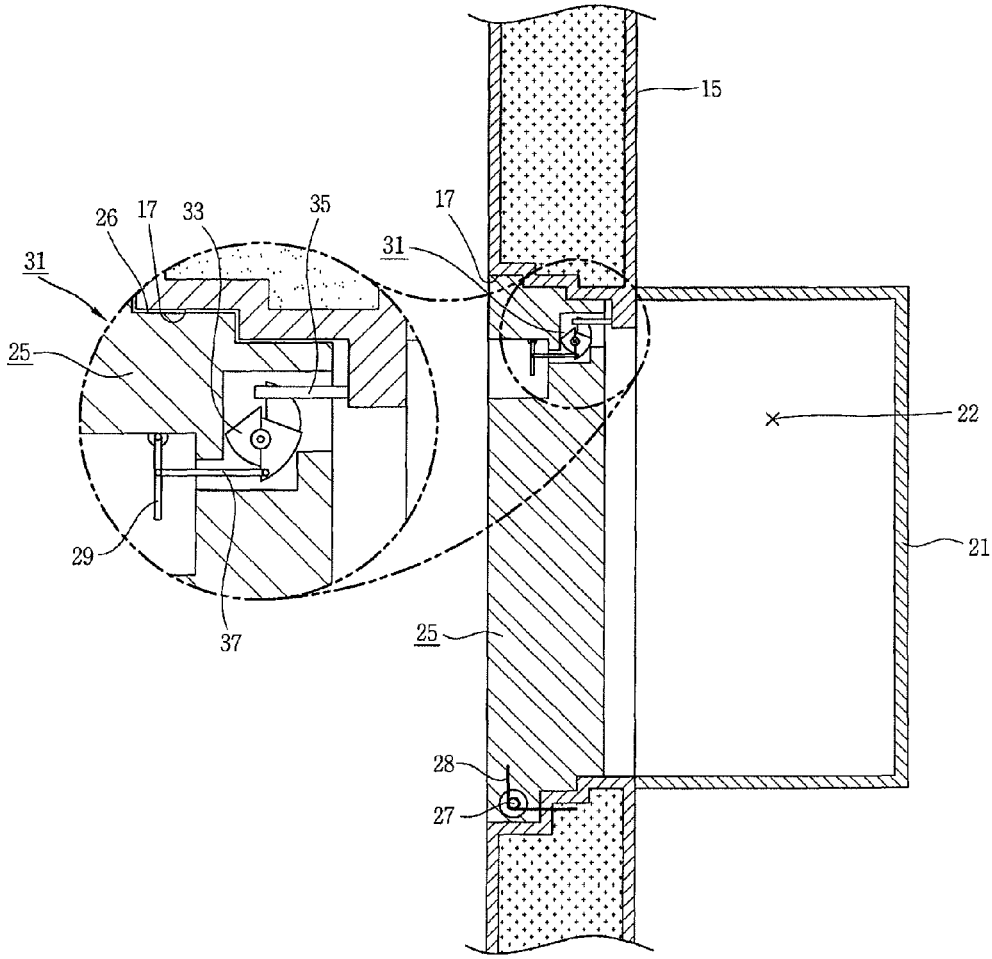
FIG. 2 RELATED ART
FIG. 2 is a horizontal cross-sectional view of a home bar area of FIG. 1.
Figure 3:
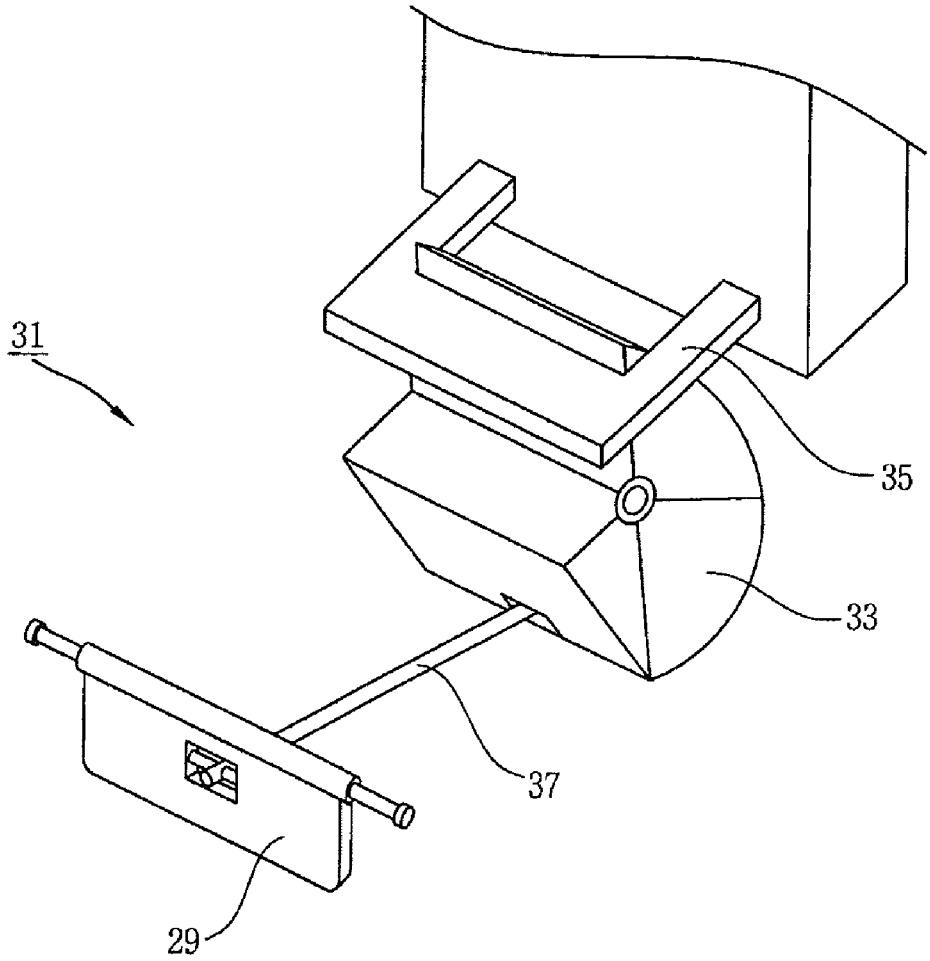
FIG. 3 RELATED ART
FIG. 3 is a perspective view of an opening/closing unit of FIG. 2.
Figure 4:
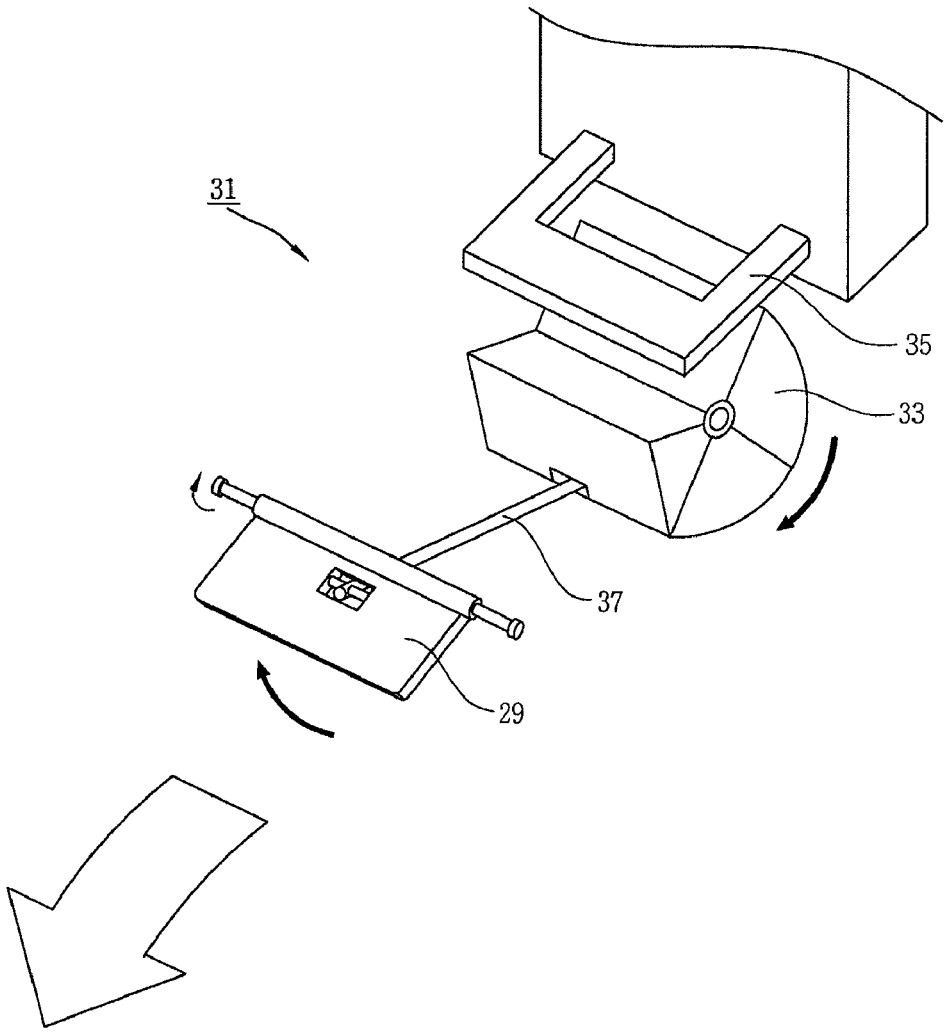
FIG. 4 RELATED ART
FIG. 4 is a view showing an unlocked state of a rotational latch of FIG. 3.

Hereinafter, the present invention will be described in detail with reference to the accompanying drawings.

As shown in FIG. 5, a refrigerator with a home bar may comprise a main body 110 of the refrigerator having a cooling chamber (not shown), e.g., a freezing chamber and a refrigerating chamber defined therein, a freezing chamber door 114 and a refrigerating chamber door 116 each coupled to the main body 110 of the refrigerator to open or close the freezing chamber and the refrigerating chamber, and a home bar 120 disposed on a front surface of the refrigerating chamber door 116. A dispenser 115 for discharging water or ice may be mounted on the front surface of the freezing chamber door 114.

As shown in FIG. 6, an opening 117 may be formed through a planar surface at a central area of the refrigerating chamber door 116. Then, the home bar 120 may be formed in the opening 117.

The home bar 120 may comprise a housing 121 formed inside the refrigerating chamber door 116 and coupled to the opening 117; a home bar door 125 coupled to the front surface of the refrigerating chamber door 116 to open or close the opening 117, and a home bar door driving unit 130 which drives the home bar door 125 to open the opening 117.

A stepped portion 118 may be formed in the opening 117 of the refrigerating chamber door 116 so as to inwardly become narrower in width. A stepped portion 126 corresponding to the stepped portion 118 may be formed on the home bar door 125 to become narrower toward the refrigerating chamber door 116.

Rotational shafts 127 may be protruded from one side of an upper surface and one side of a lower portion of the home bar door 125, respectively, in a vertical direction, so as to allow the rotation of the home bar door 125. Rotational shaft receiving portions 119 corresponding to the rotational shafts 127 may be formed in the opening 117 so as to receive each rotational shaft 127 to be rotatable.

The home bar door driving unit 130 may comprise a home bar door driving motor 131 installed in the refrigerating chamber door 116, a home bar door switch 135 for manipulating the home bar door driving motor 131, and a plurality of gears 141 for transferring a driving force from the home bar door driving motor 131 to the home bar door 125.

The home bar door driving motor 131 may be installed inside the refrigerating chamber door 116 to be arranged at a lower side of the home bar door 125. The home bar door switch 135 may be installed above the opening 117 to be manipulated from the outside.

The gears 141 may comprise a driving gear 143 integrally coupled to the rotational shaft 132 of the home bar door driving motor 131 to be rotatable, and a power transmitting gear 145 engaged with the driving gear 143 to be rotatable and transferring power. The power transmitting gear 145 may be implemented as a sector gear having a fanwise shape.

A shaft receiving opening 146 may be formed in a center of the power transmitting gear 145, as shown in FIGS. 7 and 8, such that the rotational shaft 127 of the home bar door 125 can be inserted therein. Serrations 128 and 148 may be formed at the rotational shaft 127 and the shaft receiving opening 146, respectively, to be engaged with each other for an integral rotation. Here, the home bar door driving motor 131, the driving gear 143 and the power transmitting gear 145 may also be configured to be disposed at the rotational shaft 132 arranged at the upper side of the home bar door 125.

The home bar door driving motor 131 and the home bar door switch 135, as shown in FIG. 5, may electrically be connected to the controller 150, respectively, so as to control a series of operations for opening or closing the home bar door 125 by manipulating the home bar door switch 135. Here, the home bar door switch 135 may be implemented as a push button.

With such a configuration, when the home bar door switch 135 is manipulated in a closed state of the home bar door 125, the controller 150 may control the home bar door 125 to rotate in a direction to open the opening 117. When the home bar door driving motor 131 rotates, the home bar door 125 is rotated based on the rotational shaft 127 by the driving gear 143 and the power transmitting gear 145 engaged with each other, such that the opening 117 can be open. On the other hand, when the home bar door switch 135 is manipulated upon desiring to close the home bar door 125, the controller 150 may control the home bar door driving motor 131 such that the home bar door 125 can block the opening 117. Here, the home bar door 125 may block the opening 117 by being rotated by the home bar door driving motor 131, and accordingly the gap increasing between the home bar door 125 and the opening 117 can be avoided, which results in preventing leakage of cold air.

Hereinafter, another embodiment of the present invention will be described with reference to FIGS. 9 to 13. The same parts as or similar parts to the aforementioned configuration will be omitted for the sake of description of drawings, and will be described with reference to the same reference numerals. As shown in FIG. 9, a refrigerator with a home bar may comprise: a main body 110 of the refrigerator having a cooling chamber (not shown) therein; a refrigerator door 116 coupled to the main body 110 of the refrigerator to open or close the cooling chamber and having an opening 117 formed through the planer surface thereof; and a home bar 170 which may include a housing 121 coupled to an inner surface of the refrigerator door 116 to form a storage space 172, a home bar door 175 coupled to the refrigerator door 116 to open or close the opening 117, a home bar door driving unit 180 for driving the home bar door 175 to open or close the opening 117, a basket 211 received inside the housing 121, and a basket driving unit 221 for driving the basket 211 to be drawn out or received through the opening 117.

A plurality of cooling chambers, namely, a freezing chamber and a refrigerating chamber respectively arranged at left and right sides by interposing a partition wall therebetween, may be formed in the main body 110 of the refrigerator. The refrigerator door may include a freezing chamber door 114 and a refrigerating chamber door 116 which open or close the freezing chamber and the refrigerating chamber, respectively.

A dispenser 115 may be disposed on a front surface of the freezing chamber door 114 to allow water and/or ice to be taken out without the freezing chamber door 114 open.

A home bar 170 may be formed at a central area of the refrigerating chamber door 116, as shown in FIG. 10, so as to allow water or drinks stored therein to be taken out without the refrigerating chamber door 116 open. The opening 117 may be formed through a planer surface of the refrigerating chamber door 116 so as to define the home bar 170.

The home bar 170 may include the housing 171 coupled to the opening 117 inside the refrigerating chamber door 116 to form the storage space 172, the home bar door 175 coupled to the front surface of the refrigerating chamber door 116 to open or close the opening 117, the home bar door driving unit 180 for driving the home bar door 175 to open or close the opening 117, the basket 211 received in the housing 171, and the basket driving unit 221 for driving the basket 211 to allow the basket 211 to be drawn out and received through the opening 117.

The home bar 170 may further include a manipulating unit 250 for manipulating the home bar door driving unit 180 and the basket driving unit 221, and a controller 260 for driving the home bar door driving unit 180 and the basket driving unit 221 according to a signal from the manipulating unit 250. The manipulating unit 250 may be mounted above the opening 117 to allow it to be handled outside of the main body 110.

The opening 117 may include a stepped portion 178, which gradually becomes narrower in width toward the inside of the refrigerating chamber door 116, so as to prevent leakage of cold air when the home bar door 175 blocks the opening 117. Corresponding to the stepped portion 178, a stepped portion 176 may be formed at an inner side of the home bar door 175 to gradually become narrower in width.

The home bar door driving unit 180, as shown in FIG. 11, may include a home bar door driving motor 181 disposed in one side of the home bar door 175, and a plurality of gears 190 for transferring a driving force from the home bar door driving motor 181 to the home bar door 175.

A rotational shaft 177 may horizontally be arranged at one side of the home bar door 175. Upper and lower areas of the rotational shaft 177 may rotatably be supported by the refrigerating chamber door 116. The home bar door driving motor 181 may integrally be connected to a lower end of the rotational shaft 177 to be rotatable.

The gears 190 may include a driving gear 191 integrally coupled to the rotational shaft 177 to be rotatable, and a power transmitting gear 195 engaged with the driving gear 191.

The driving gear 191 may be composed of an upper driving gear 192*a* and a lower driving gear 192*b* coupled to the rotational shaft 177 and spaced apart from each other in a longitudinal direction, and the power transmitting gear 195 may be composed of an upper power transmitting gear 196*a* and a lower power transmitting gear 196*b* engaged with the upper driving gear 192*a* and the lower driving gear 192*b*, respectively.

Each driving gear 191 may be implemented in a shape of a pinion. Each power transmitting gear 195 may be formed in an arc (arch, arcuate, etc.) shape, and may be implemented as an internal gear having a teeth portion on an inner side surface thereof.

One end of the power transmitting gear 195 may be fixed to the home bar door 175, and the other end thereof may be received in a power transmitting gear receiving portion 197 formed at the refrigerating chamber door 116, such that the power transmitting gear 195 can be drawn out therefrom. The power transmitting gear receiving portion 197 may have an arc (arch, arcuate, etc.) shape corresponding to the shape of the power transmitting gear 195 and have a storage space therein. Accordingly, when each driving gear 191 rotates, the corresponding power transmitting gear 195 may be moved relatively with respect to the driving gear 191 to be drawn out of or received in the power transmitting gear receiving portion 197. As a result, the home bar door 175 may rotate based on the rotational shaft 177 so as to open or close the opening 117.

The basket 211 may be formed to have an upper surface open in a horizontal direction to thusly accommodate items 212 (e.g., bottles or the like) therein. The basket driving unit 221 for driving the basket 211 to be drawn out or received through the opening 117 may be disposed at a lower side of the basket 211.

The basket driving unit 221, as shown in FIGS. 11 and 12, may include rack teeth portions 224 formed on a lower surface of the basket 211 along a direction in which the basket 211 is moved, a pinion 227 arranged at the refrigerating chamber door 116 to be engaged with the rack teeth portions 224 for rotation, and a basket driving motor 231 for driving the pinion 227.

The rack teeth portions 224 may include a first rack teeth portion 225*a* and a second rack teeth portion 225*b* formed at both lower sides of the basket 211, respectively. The pinion 227 may include a first pinion 228*a* and a second pinion 228*b* engaged with the first rack teeth portion 225*a* and the second rack teeth portion 225*b*, respectively, to thusly rotate together.

The first and second pinions 228*a* and 228*b* may be coupled to a single rotational shaft 230 with being spaced apart from each other. The basket driving motor 231 may integrally be connected to one end of the rotational shaft 230 so as to rotate each of the first and second pinions 228*a* and 228*b*.

A basket supporting unit 235 may be formed on the lower surface of the basket 211 such that the basket 211 can be slidably drawn out or received therein in back and forth directions. The basket supporting unit 235 may include guide rails 236 mounted on the lower surface of the basket 211, and guide bars 238 slidably coupled to the guide rails 236. Slots 237 in which the guide rails 236 are inserted to be slidable may be formed between each guide rail 236 and the lower surface of the basket 211. The guide bars 238 may be fixed to the housing 171. Here, the guide bar 238 may be configured as a telescopic bar having an adjustable length such that a drawn-out distance of the basket 211 can further extend.

The home bar door driving motor 181 and the basket driving motor 231 may electrically be connected to the controller 260, respectively, so as to control a series of operations for opening the home bar door 175 and drawing the basket 211 out by the manipulation of the manipulating unit 250. Under the state where the basket 211 is received and the home bar door 175 is closed, the controller 260 may control the home bar door driving motor 181 and the basket driving motor 231 such that the home bar door 175 can be open and the basket 211 can be drawn out. Also, under the state where the home bar door 175 is open and the basket 211 is drawn out, the controller 260 may control the home bar door driving motor 181 and the basket driving motor 231 such that the basket 211 can be received and the home bar door 175 can be closed.

Here, as shown in FIG. 13, the manipulating portion 250 may be composed of a home bar door manipulating switch 252 and a basket manipulating switch 254, which independently control the opening/closing operation for the home bar door 175 and a draw-out and receiving operation for the basket 211. This must be intended such that because the items 212 may not be stored on a path on which the basket 211 is moved in order to be drawn out, items 212 which may not be available to be stored in the basket 211 can be stored in the housing 171, so as to improve utility of the home bar 170. That is, if items 212 are stored in another space other than the basket 211, only the home bar door manipulating switch 252 may be manipulated such that the home bar door 175 can be open or closed regardless of the movement of the basket 211.

The home bar door manipulating switch 252 and the basket manipulating switch 254 may electrically connected to the controller 260 so as to control the opening/closing operation for the home bar door 175 and the draw-out and receiving operation for the basket 211, respectively. The controller 260 may control the home bar door driving motor 181 to open or close the home bar door 175 when a manipulating signal is inputted from the home bar door manipulating switch 175, and also control the basket driving motor 231 to draw out or receive the basket 211 when a manipulating signal is inputted from the basket manipulating switch 254.

With the configuration, when desiring to take out items 212 stored in the basket 211 or store the items 212 in the basket 211, a user just has to manipulate the manipulating unit 250. Accordingly, when a manipulating signal is inputted by the manipulating unit 250, the controller 260 may control the home bar door driving motor 181 such that the home bar door 175 can be open. When the home bar door 175 is open, the controller 260 may then control the basket driving motor 231 such that the basket 211 can be drawn out.

When the home bar door driving motor 181 rotates, the rotational shaft 177 and the driving gears 191 of the home bar door 175 may rotate. Accordingly, the power transmitting gear 195 engaged with each driving gear 191 may be drawn out of the power transmitting gear receiving portion 197. As a result, the home bar door 175 may rotate based on the rotational shaft 177 to thusly open the opening 117.

When the home bar door 175 opens the opening 117, the controller 260 may control the basket driving motor 231 such that the basket 211 can be drawn out. When the basket driving motor 231 starts rotating, the rotational shaft 230 and the pinions 227 may be simultaneously rotated, and the rack teeth portions 224 may be relatively moved in back and forth directions. Accordingly, the basket 211 may be moved forwardly by being supported by the basket supporting unit 235 to be drawn out of the opening 117.

On the meantime, when the manipulating unit 250 is manipulated after taking out or store items 212 from/in the basket 211, the controller 260 may control the basket driving motor 231 such that the basket 211 can be received in the housing 171. After the basket 211 is completely received, the controller 260 may control the home bar door driving motor 181 such that the home bar door 175 can block the opening 117.

The preferred embodiments of the present invention have been described, but various modifications and variations can be made in the present invention without departing from the spirit or scope of the invention. Thus, the aforementioned embodiments must be construed widely within the scope defined in the appended claims. Also, it is intended that the present invention cover modifications and variations of this invention provided they come within the scope of the appended claims and their equivalents.

The invention claimed is:

1. A refrigerator comprising:

a main body of the refrigerator, the main body having a cooling chamber;

a refrigerator door to open or close the cooling chamber and having an opening;

a home bar including a housing coupled to the opening and forming a storage space therein, a home bar door having an upper and a lower portion to rotatably open or close the opening by rotation about a rotational shaft disposed at one side of the home bar door in a longitudinal direction of the home bar door, the rotational shaft extending from the upper portion of the home bar door to the lower portion of the home bar door having an upper region and a lower region each rotatably supported by the refrigerator door, a home bar door driving unit to drive the home bar door to open or close the opening, a basket received in the housing, and a basket driving unit to drive the basket to be drawn out and received through the opening;

a manipulating unit mounted to be exposed to the outside of the refrigerator door; and a controller to control the home bar door driving unit and the basket driving unit based on a manipulating signal of the manipulating unit such that the home bar door and the basket can be driven consecutively.

2. The refrigerator of claim 1, wherein the home bar door driving unit comprises a home bar door driving motor disposed in the refrigerator door, and a plurality of gears interposed between the home bar door driving motor and the rotational shaft of the home bar door.

3. The refrigerator of claim 2, wherein the basket driving unit comprises rack teeth portions formed on the lower surface of the basket, pinions engaged with the rack teeth portions, and a basket driving motor for driving the pinions.

4. The refrigerator of claim 2, wherein the gears comprises a power transmitting gear formed in an arc shape and having a teeth portion formed inside thereof, and a pinion engaged to the power transmitting gear by the teeth portion.

5. The refrigerator of claim 4, wherein one end of the power transmitting gear is connected to the home bar door, and the power transmitting gear is disposed at each of the upper and lower portions of the home bar door.

6. The refrigerator of claim 5, wherein the power transmitting gear is simultaneously coupled to the rotational shaft.

7. The refrigerator of claim 4, wherein the home bar further comprises a power transmitting gear receiving portion in which the power transmitting gear is received to be drawn out.

8. The refrigerator of claim 3, wherein home bar further comprises a basket supporting unit for supporting the basket to be slidable in back and forth directions.

9. The refrigerator of claim 8, wherein the basket supporting unit comprises guide rails mounted on the lower surface of the basket, and guide bars formed in the housing to guide the guide rails.

10. The refrigerator of claim 1, wherein, when the manipulating signal is inputted from the manipulating unit in a closed state of the home bar door, the controller controls the home bar door driving unit and the basket driving unit to externally draw the home bar out through the opening after the home bar door is open.

11. The refrigerator of claim 1, wherein, when the manipulating signal is inputted from the manipulating unit in a state of the basket being drawn out, the controller controls the basket driving unit and the home bar door driving unit such that the home bar door closes the opening after the basket is received within the housing through the opening.

12. A refrigerator comprising:

a main body of the refrigerator, the main body having a cooling chamber;

a refrigerator door to open or close the cooling chamber and having an opening; and a home bar including a housing coupled to the opening and forming a storage space therein, a home bar door having an upper and a lower portion to rotatably open or close the opening by rotation about a rotational shaft disposed at one side of the home bar door in a longitudinal direction of the home bar door, the rotational shaft extending from the upper portion of the home bar door to the lower portion of the home bar door having an upper region and a lower region each rotatably supported by the refrigerator door, a home bar door driving unit to drive the home bar door to open or close the opening, a basket received in the housing, and a basket driving unit to drive the basket to be drawn out and received through the opening;

a manipulating unit mounted to be exposed to the outside of the refrigerator door; and a controller to control the home bar door driving unit and the basket driving unit based on a manipulating signal of the manipulating unit such that the home bar door and the basket can be driven simultaneously or independently.

13. The refrigerator of claim 12, wherein the manipulating unit comprises a home bar door manipulating switch and a basket manipulating switch to independently control an opening/closing operation for the home bar door and a draw-out and receiving operation for the basket, respectively.

14. The refrigerator of claim 13, wherein the home bar door driving unit comprises a home bar door driving motor disposed in the refrigerator door, and a plurality of gears interposed between the home bar door driving motor and the rotational shaft of the home bar door.

15. The refrigerator of claim 14, wherein the basket driving unit comprises rack teeth portions formed on a lower surface of the basket, a pinion engaged with the rack teeth portions, and a basket driving motor to drive the pinion.

16. The refrigerator of claim 15, wherein the controller controls the home bar door driving motor such that the home bar door is open or closed when a signal is inputted from the home bar door manipulating switch.

17. The refrigerator of claim 16, wherein the controller controls the basket driving motor such that the basket is drawn out or received when a signal is inputted from the basket manipulating switch.

* * * * *